US011352204B2

(12) United States Patent
Moore

(10) Patent No.: US 11,352,204 B2
(45) Date of Patent: Jun. 7, 2022

(54) TRASH RECEPTACLE LINER

(71) Applicant: Catrice Reimon Moore, Cape Girardeau, MO (US)

(72) Inventor: Catrice Reimon Moore, Cape Girardeau, MO (US)

( * ) Notice: Subject to any disclaimer, the term of this patent is extended or adjusted under 35 U.S.C. 154(b) by 284 days.

(21) Appl. No.: 16/259,106

(22) Filed: Jan. 28, 2019

(65) Prior Publication Data

US 2019/0256283 A1 Aug. 22, 2019

Related U.S. Application Data

(60) Provisional application No. 62/622,398, filed on Jan. 26, 2018.

(51) Int. Cl.
*B65D 30/16* (2006.01)
*B65F 1/06* (2006.01)
*B65F 1/14* (2006.01)

(52) U.S. Cl.
CPC ..... *B65F 1/065* (2013.01); *B65F 1/068* (2013.01); *B65F 1/1415* (2013.01)

(58) Field of Classification Search
CPC ..... B65F 1/065; B65F 1/06; B65F 1/0006; B65F 1/08; B65F 1/068; B65F 1/1415
USPC .... 220/495.01, 495.06, 495.08, 495.11, 908, 220/908.1; 383/33
See application file for complete search history.

(56) References Cited

U.S. PATENT DOCUMENTS

| | | | | |
|---|---|---|---|---|
| 5,022,767 | A | 6/1991 | Cardulla | |
| 6,315,143 | B1 | 11/2001 | Dotts | |
| 7,252,207 | B2 | 8/2007 | Liao | |
| 8,955,706 | B2 * | 2/2015 | Gagnebin | B65F 1/08 220/495.04 |
| 2003/0136787 | A1 | 7/2003 | Singuillo | |
| 2008/0056625 | A1 | 3/2008 | Stanton | |
| 2008/0226205 | A1 | 9/2008 | Sillik | |
| 2010/0247002 | A1 | 9/2010 | Ross | |
| 2015/0001332 | A1 | 1/2015 | Qin | |
| 2016/0023808 | A1 * | 1/2016 | Traverso | B65D 33/25 383/108 |
| 2016/0052710 | A1 * | 2/2016 | Butler | B65F 1/06 220/560 |
| 2017/0362024 | A1 * | 12/2017 | Antal | B65F 1/1607 |

* cited by examiner

*Primary Examiner* — Don M Anderson
*Assistant Examiner* — Elizabeth J Volz

(57) ABSTRACT

A device for lining a trash receptacle; the device includes a body and a top-lip, the top-lip configured to attach to a top of the trash receptacle. In some embodiments, a zip tie is provided to tighten the top-lip around the top of the trash receptacle. The device has a structured base allowing the device to stand up-right whilst in the trash receptacle. In some embodiments, the device includes a handle to allow for quick and easy removal of the device from the trash receptacle.

18 Claims, 6 Drawing Sheets

TRASH RECEPTACLE LINER

CROSS REFERENCE TO RELATED APPLICATION

The present application is related to and claims priority to U.S. Provisional Patent Application No. 62/622,398 filed Jan. 26, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of trash and more specifically relates to trash liners.

2. Description of Related Art

Standard plastic trash bags may be difficult to install in a trash receptacle. People may be unable to tightly secure the bag within the receptacle, leading to the bag falling down within the interior. The plastic bags may be flimsy and susceptible to holes and leaks. Trash can leak within the receptacle, creating numerous unwanted odors and requiring constant cleaning. A suitable solution is desired.

U.S. Pat. No. 7,252,207 to Samson S. C. Liao relates to a liner support for a container such as a garbage can. The described liner support for a container such as a garbage can includes an internal support or support frame for a liner used to protect the inside surface of a container from coming in contact with the contents to be deposited therein. For example, garbage can liners are provided to protect the inside surfaces of garbage cans from coming in contact with and thus contaminated by the garbage that is deposited and stored therein. The internal support or support frame provides that the liner is contained entirely within the container, without having to lap or drape over the exterior of the container. This eliminates a problem associated with using plastic liners draped over the outside of containers such as garbage cans that usually result in an unsightly situation, especially in the case of decorative trash cans.

BRIEF SUMMARY OF THE INVENTION

In view of the foregoing disadvantages inherent in the known trash art, the present disclosure provides a novel trash receptacle liner. The general purpose of the present disclosure, which will be described subsequently in greater detail, is to provide an improved trash receptacle liner capable of firmly securing trash and reducing leaks.

A device is disclosed herein. The device includes a body which may include a closed-base and an open-top relative to a trash receptacle. The closed-base may include a support-structure configured to support the body in an up-right position. Further, a top-lip may be located around the open-top of the body. The top-lip may include a rigid-structure and may be configured to attach to a receptacle-top of the trash receptacle.

A method of using device is also disclosed herein. The method of using the device may comprise the steps of: providing the device as above; inserting the body into the trash receptacle such that the closed-base may be flush with a bottom of the trash receptacle; and attaching the top-lip to the receptacle-top.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a trash receptacle liner, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to trash and more particularly to a trash receptacle liner as used to improve efficient and effective trash liner usage.

Generally, disclosed is an improved trash receptacle liner. The trash receptacle liner may include a firm top ring around a perimeter of the liner which, when secured via a zip tie mechanism, tightly secures the liner within the trash receptacle. The ring construction effectively prevents the bag from falling down within the receptacle before being completely filled with trash. The device may feature a flexible construction capable of supporting trash within the receptacle while fully filling the bag. This may eliminate the liner from sliding into the can and causing messes. Further, the trash receptacle liner may include a firm base section which allows the bag to stand upright and contain all trash placed in the bag. The liner may be custom fit to virtually any type and size of trash receptacle. Exact specifications may vary upon further development and manufacturing.

Referring now more specifically to the drawings by numerals of reference, there is shown in FIGS. 1-5, various views of a device 100.

Figure 1:
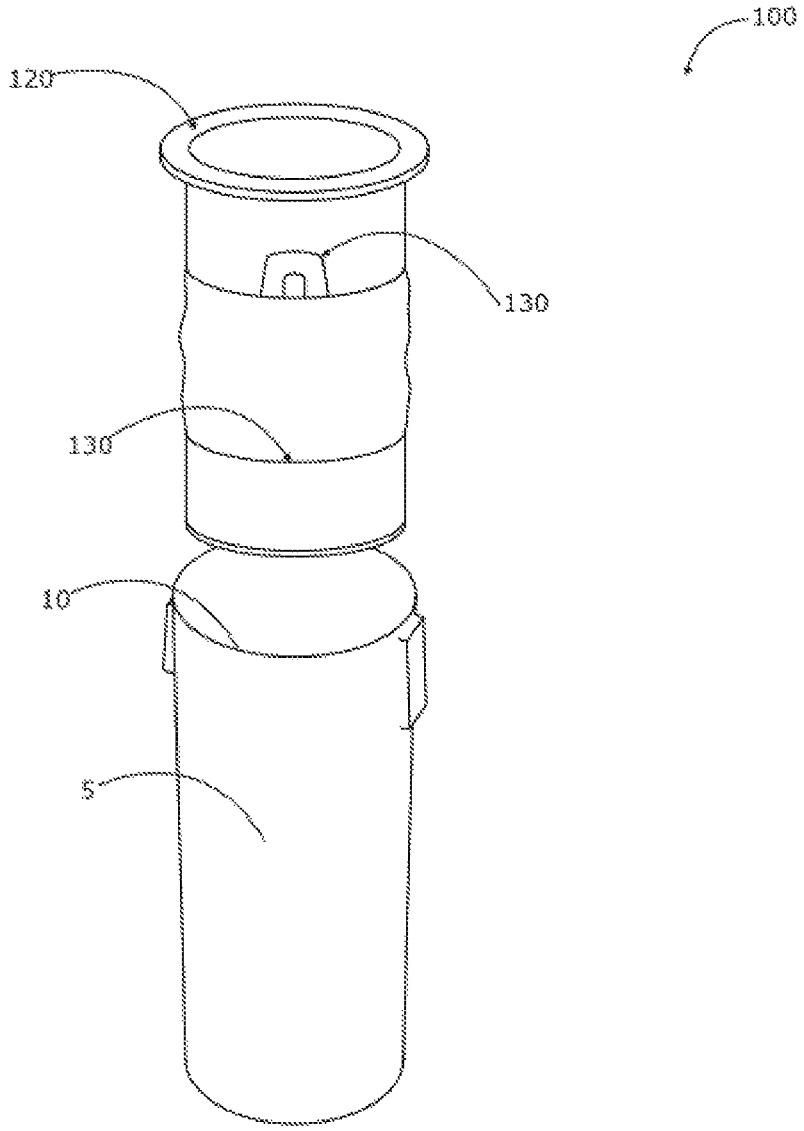
FIG. 1 is a front-top perspective view of the device during an 'in-use' condition, according to an embodiment of the disclosure.

FIG. 1 shows a device 100 during an 'in-use' condition 150, according to an embodiment of the present disclosure. As illustrated, the device 100 may include a body 110 and a top-lip. As shown, the device 100 may be used for lining a trash receptacle 5. The trash receptacle 5 may include a receptacle-top 10. Further, as shown here, the device 100 may include a handle 130. The handle 130 may allow a user to easily and quickly remove the device 100 from the trash receptacle 5.

Figure 2:
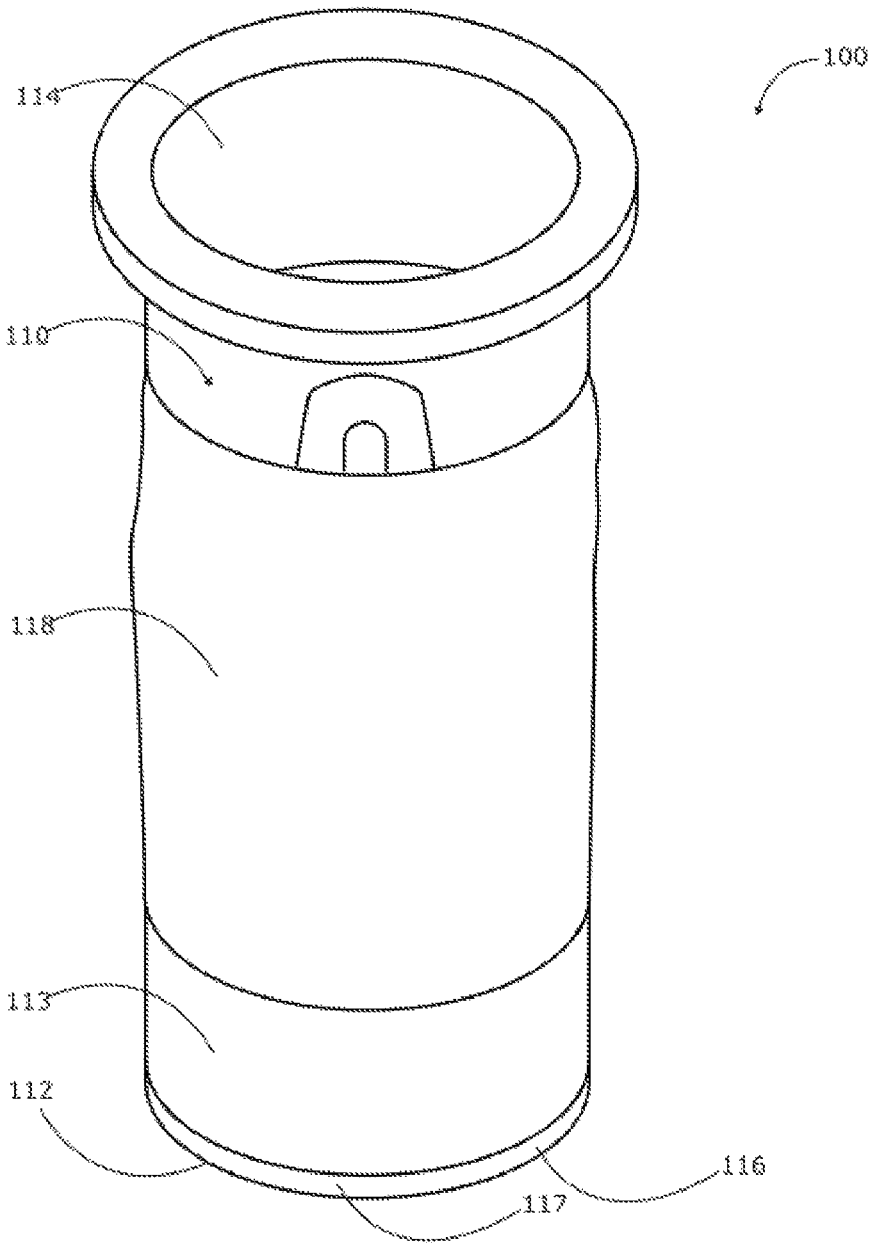
FIG. 2 is a front-top perspective view of the device of FIG. 1, according to an embodiment of the present disclosure.

FIG. 2 shows a front-top perspective view of the device 100 of FIG. 1, according to an embodiment of the present disclosure. The body 110 may include a closed-base 112 and an open-top 114 relative to the trash receptacle 5 (FIG. 1). The body 110 may be constructed from a first plastic material 113. Preferably, the first plastic material 113 may be a thick plastic. For example, the first plastic material 113 may be high density polyethylene. In this embodiment, the body 110 may be at least 6.0 mil. In one embodiment, the body 110 may be thick but highly flexible. In another embodiment, the body 110 may be thicker and less flexible. In this embodiment, the first plastic material 113 may be PVC, PET, Polypropylene, etc.

The closed-base 112 may include a support-structure 116 configured to support the body 110 in an up-right position. The support structure may be constructed from a second plastic material 117. The second plastic material 117 may be different from the first plastic material 113 in one embodiment. In another embodiment, the first plastic material 113 and the second plastic material 117 may be the same. As shown, the body 110 may include a cylindrical shape when standing up-right. Further, as shown, in one embodiment, the body 110 may include a support-frame 118. The support-frame 118 may further help support the body 110 within the trash receptacle 5.

Figure 3:
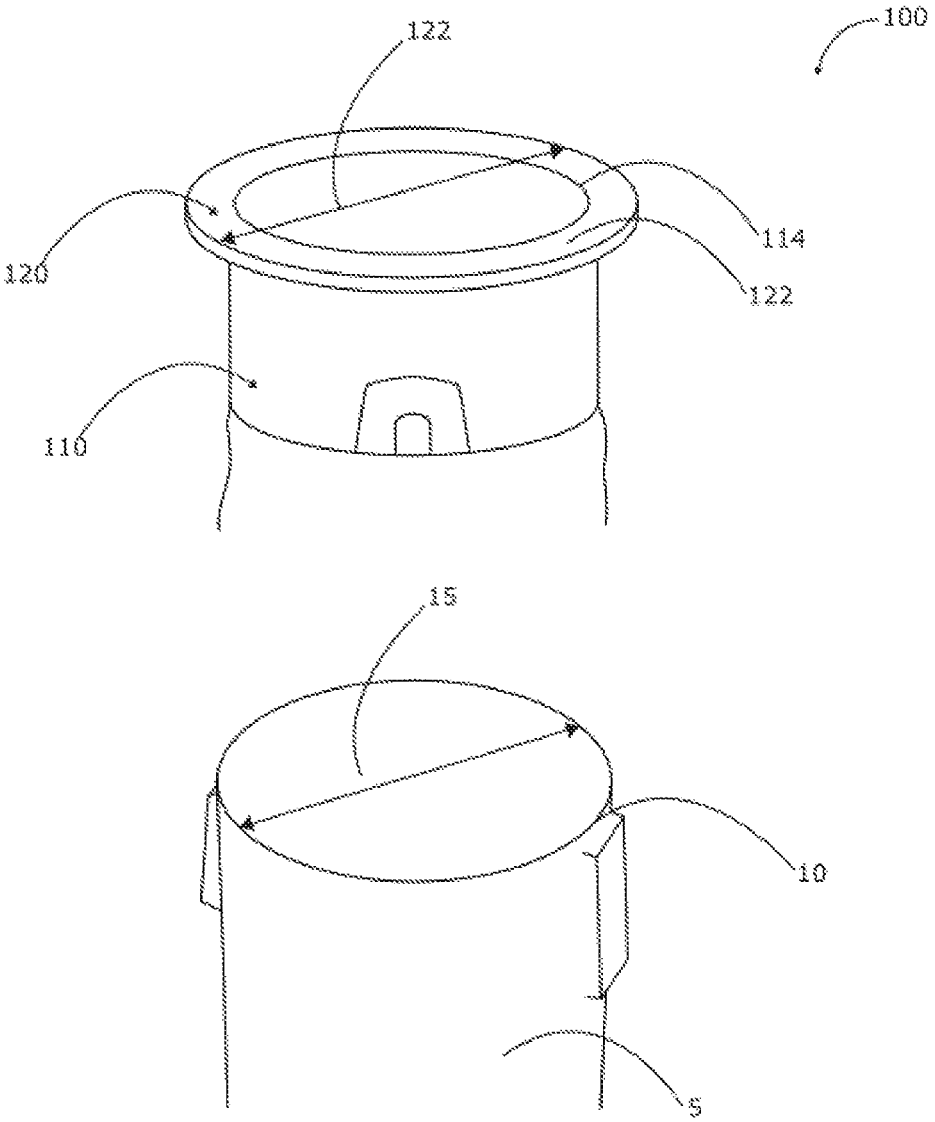
FIG. 3 is a front perspective view of the device of FIG. 1, according to an embodiment of the present disclosure.

FIG. 3 shows a front perspective view of the device 100 of FIG. 1, according to an embodiment of the present disclosure. As shown, the top-lip 120 may be located around the open-top 114 of the body 110. The top-lip 120 may include a rigid-structure 122 and may be configured to attach to the receptacle-top 10 of the trash receptacle 5. A size of the open-top 114 may be adjustable via the top-lip. For example, a user may manipulate the top-lip 120 and tighten the top lip over the receptacle-top 10, thus making an opening of the open-top 114 smaller. In one embodiment, the top-lip 120 may have a greater lip-diameter 121 than a receptacle-top diameter 15 of the receptacle-top 10. The difference in diameter 121 may be small, but enough to allow the top-lip 120 to encompass the receptacle-top 10. In another embodiment, the top-lip 120 may include a mating means (not illustrated) configured to mate with the receptacle-top 10.

Preferably, the top-lip 120 may include a circular shape. In this embodiment, the receptacle-top 10 may include the circular shape also, to allow the top-lip 120 to encompass/mate with the receptacle-top 10. A shape of the top-lip 120 may be customizable or changeable according to the trash receptacle 5 it needs to fit. For example, the top-lip 120 may include a rectangular-shape and receptacle-top 10 may include the rectangular shape, or the top-lip 120 may include a square shape and the receptacle-top 10 may also include the square shape. Other profiles are envisioned.

Figure 4A:
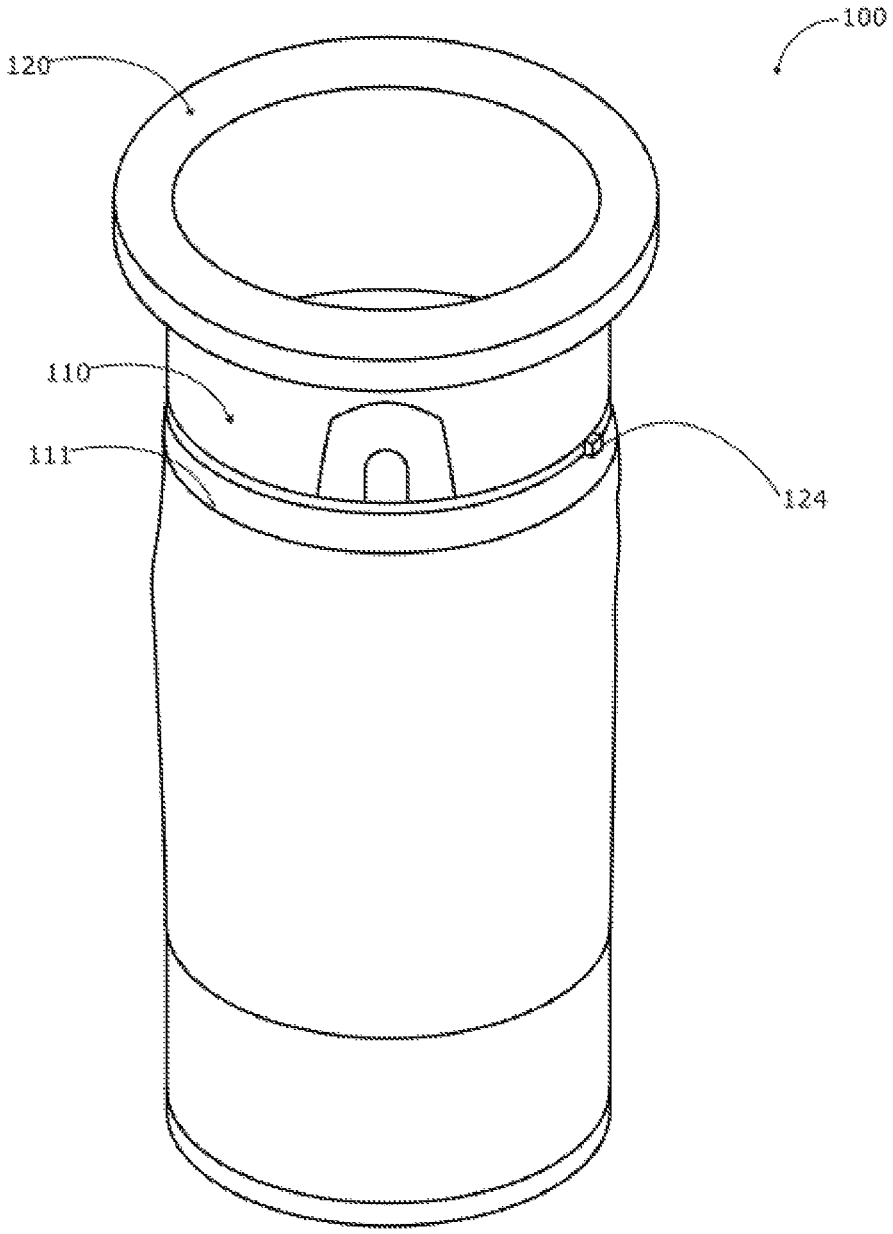
FIG. 4A is a front perspective view of the device of FIG. 1, according to an embodiment of the present disclosure.
Figure 4B:
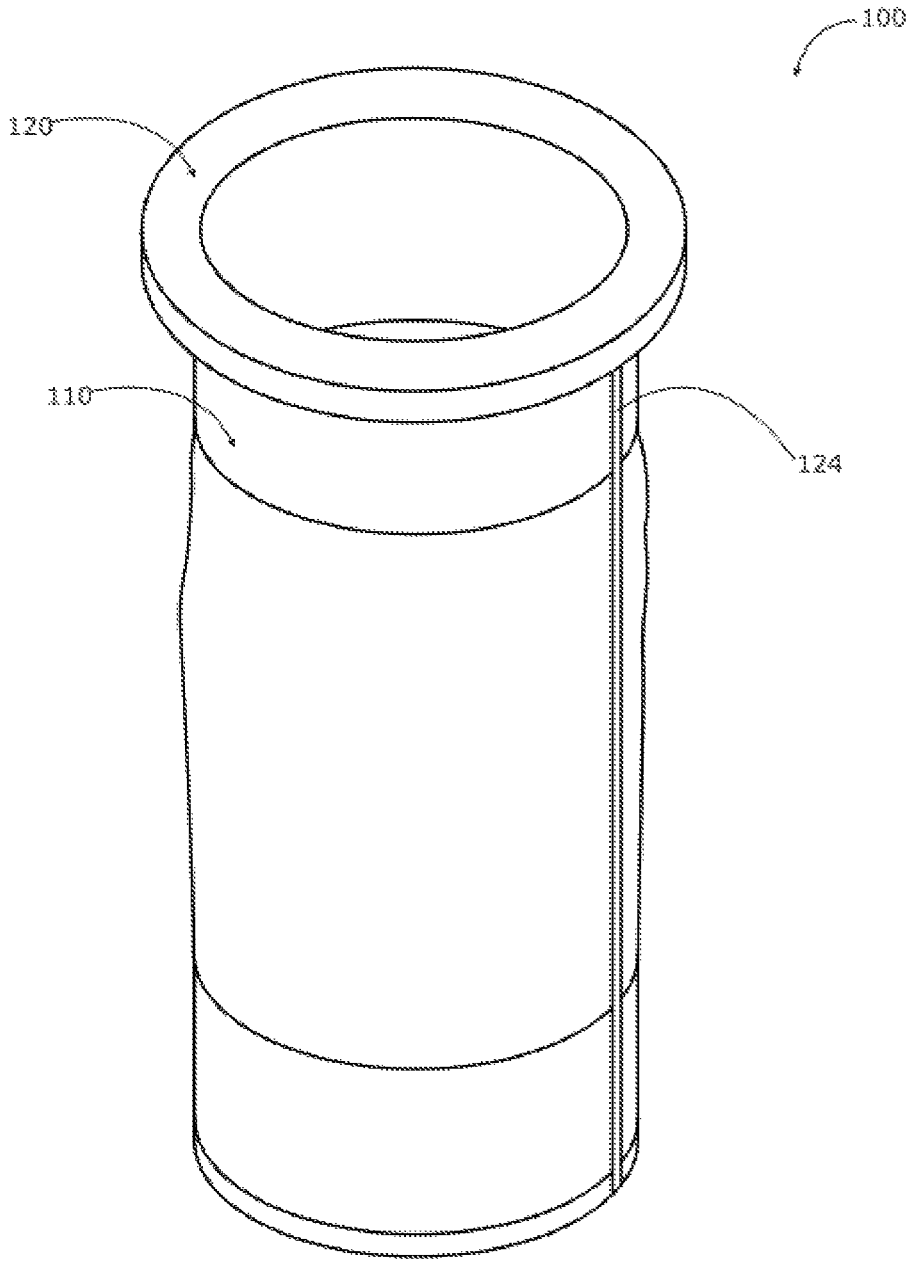
FIG. 4B is a front-top perspective view of the device of FIG. 1, according to an embodiment of the present disclosure.

FIGS. 4A-4B show front-top perspective views of the device 100 of FIG. 1, according to an embodiment of the present disclosure. As above, the size of the open-top 114 may be adjustable via the top-lip 120. In one embodiment, a tightening-mechanism 124 may be provided to aid in this. The tightening-mechanism 124 may be in communication with the top-lip 120 and configured to selectively tighten the top-lip 120 around the receptacle-top 10 when the top-lip 120 is attached to the receptacle-top 10 (FIG. 3). Preferably, the tightening-mechanism 124 may be a zip tie. In another embodiment, the tightening-mechanism 124 may be a draw-string. Further, in one embodiment, the body 110 may include a functional decorative strip 111 around a body-circumference thereof. In this embodiment, the tightening-mechanism 124 may be housed within the functional decorative strip.

Figure 5:
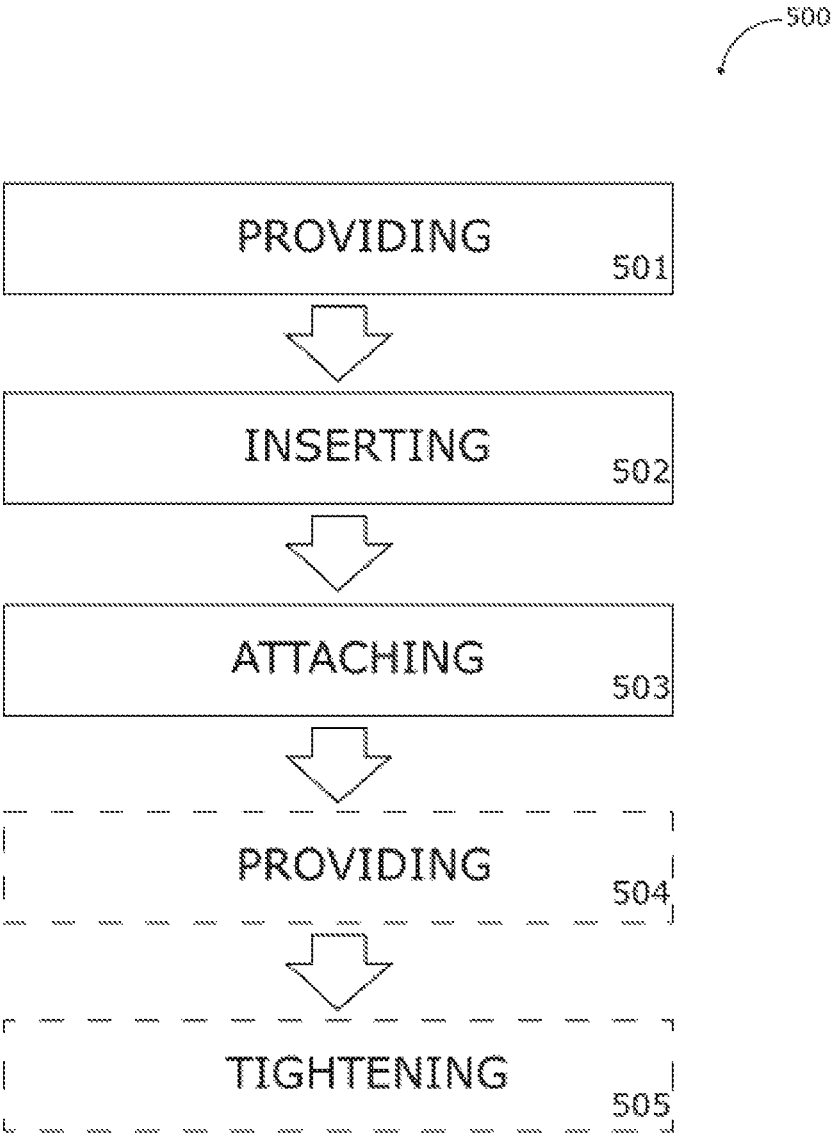
FIG. 5 is a flow diagram illustrating a method of use for the device, according to an embodiment of the present disclosure.

FIG. 5 is a flow diagram illustrating a method of using a device for lining a trash receptacle 500, according to an embodiment of the present disclosure. As illustrated, the method of using a device for lining a trash receptacle 500 may include the steps of: providing 501 the device as above; inserting 502 the body into the trash receptacle such that the closed-base may be flush with a bottom of the trash receptacle; and attaching 503 the top-lip to the receptacle-top. Further steps may include: providing 504 a tightening-mechanism in communication with the top-lip; and tightening 505 the top-lip around the receptacle-top via the tightening-mechanism.

It should be noted that step 504 and 505 are optional steps and may not be implemented in all cases. Optional steps of method of use 500 are illustrated using dotted lines in FIG. so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use of device 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A device for lining a trash receptacle, the trash receptacle including a receptacle-top, the device comprising:

a body including a closed-base and an open-top relative to the trash receptacle, the closed-base including a support-structure configured to support the body in an up-right position;

a top-lip located around the open-top of the body, the top-lip including a rigid-structure, the top-lip configured to attach to the receptacle-top of the trash receptacle;

and wherein a size of the open-top is adjustable via the top-lip.

2. The device of claim 1, further comprising a tightening-mechanism in communication with the top-lip, and wherein the tightening-mechanism is configured to selectively tighten the top-lip around the receptacle-top when the top-lip is attached to the receptacle-top.

3. The device of claim 2, wherein the tightening-mechanism includes a zip tie.

4. The device of claim 1, wherein the body further includes a functional decorative strip around a body-circumference thereof.

5. The device of claim 4, wherein the tightening-mechanism is housed within the functional decorative strip.

6. The device of claim 1, further comprising a handle.

7. The device of claim 1, wherein the top-lip includes a circular shape, and wherein the receptacle-top includes the circular shape.

8. The device of claim 7, wherein the top-lip has a greater lip-diameter than a receptacle-top diameter of the receptacle-top.

9. The device of claim 1, wherein the top-lip includes a rectangular shape, and wherein the receptacle-top includes the rectangular shape.

10. The device of claim 1, wherein the top-lip includes a square shape, and wherein the receptacle-top includes the square shape.

11. The device of claim 1, wherein the body is constructed from a first plastic material.

12. The device of claim 11, wherein the first plastic material is high density polyethylene.

13. The device of claim 11, wherein the body is at least 6.0 mil.

14. The device of claim 1, wherein the support structure is constructed from a second plastic material.

15. The device of claim 1, wherein the body has a cylindrical shape when standing up-right.

16. The device of claim 1, wherein the body further includes a support-frame.

17. A method of using a device for lining a trash receptacle, the method comprising the steps of:

providing a device for lining a trash receptacle, the trash receptacle including a receptacle-top, the device having:

a body including a closed-base and an open-top relative to the trash receptacle, the closed-base including a support-structure configured to support the body in an up-right position; and a top-lip located around the open-top of the body, the top-lip including a rigid-structure, the top-lip configured to attach to the receptacle-top of the trash receptacle wherein a size of the open-top is adjustable via the top-lip;

inserting the body into the trash receptacle such that the closed-base is flush with a bottom of the trash receptacle; and attaching the top-lip to the receptacle-top.

18. The method of claim 17, further comprising the steps of:

providing a tightening-mechanism in communication with the top-lip; and tightening the top-lip around the receptacle-top via the tightening-mechanism.

* * * * *